US006588027B1

(12) United States Patent
Bowden et al.

(10) Patent No.: US 6,588,027 B1
(45) Date of Patent: Jul. 8, 2003

(54) TOILET SEAT LIFTING MECHANISM

(76) Inventors: Juanita Bowden, 17430 Highway 125 South, Bolivar, TN (US) 38008; Walter L. Bowden, Jr., 17430 Highway 125 South, Bolivar, TN (US) 38008

( * ) Notice: Subject to any disclaimer, the term of this patent is extended or adjusted under 35 U.S.C. 154(b) by 0 days.

(21) Appl. No.: 10/286,608

(22) Filed: Nov. 4, 2002

(51) Int. Cl.[7] ..... A47K 13/10
(52) U.S. Cl. ..... 4/246.1; 4/246.4
(58) Field of Search ..... 4/246.1, 246.2, 4/246.3, 246.4, 246.5; 220/262, 263, 264

(56) References Cited

U.S. PATENT DOCUMENTS

| | | | | | |
|---|---|---|---|---|---|
| 1,343,830 | A | * | 6/1920 | Kinch | 4/246.5 |
| 1,999,555 | A | | 4/1935 | Adams | |
| 2,088,050 | A | * | 7/1937 | Brown | 4/246.4 |
| 2,305,147 | A | * | 12/1942 | Deal | 4/241 |
| 2,473,082 | A | | 6/1949 | Warner | |
| 3,493,974 | A | * | 2/1970 | Smith | 4/246.5 |
| 4,150,446 | A | | 4/1979 | Crocker | |
| 4,592,097 | A | * | 6/1986 | Zimmerman | 4/246.4 |
| 5,060,318 | A | | 10/1991 | Jaskiewicz | |
| 5,745,930 | A | * | 5/1998 | Fallen | 4/246.1 |
| 5,852,833 | A | * | 12/1998 | Gregoire | 4/246.3 |
| 5,857,223 | A | * | 1/1999 | Ferdinand | 4/246.1 |
| D406,884 | S | | 3/1999 | Goss | |
| 6,470,503 | B1 | * | 10/2002 | Holmes | 4/246.1 |

* cited by examiner

*Primary Examiner*—Steven O. Douglas
*Assistant Examiner*—Khoa Huynh
(74) *Attorney, Agent, or Firm*—Donald R. Schoonover

(57) ABSTRACT

A mechanism lifts a toilet seat from a condition covering the toilet bowl to a condition in which the seat is upright with respect to a top rim of the toilet bowl. The mechanism includes a foot pedal in front of the toilet bowl. The foot pedal is connected to the toilet seat by a mechanism that includes a third class lever.

1 Claim, 1 Drawing Sheet

TOILET SEAT LIFTING MECHANISM

BACKGROUND OF THE INVENTION

1. Field of the Invention

The present invention relates to the general art of bathrooms, and to the particular field of commodes.

2. Discussion of the Related Art

There is a constant running battle between people regarding the proper position of a toilet seat. There are those who believe that the proper position of a toilet seat is closed over the toilet bowl, and there are those who believe that there is no required protocol for toilet seat position and any position of the toilet seat, even "up" uncovering the toilet bowl, is acceptable. People from both groups often inhabit the same domicile.

Accordingly, people from the first group, relying on a toilet seat being down when they seat themselves, often encounter the toilet bowl rather than the expected toilet seat. This is not only disconcerting, it can be dangerous, especially to an older person.

For purposes of this disclosure, a toilet seat is in an "up" condition when that toilet seat is located in a plane that is upright with respect to a plane containing the rim of the toilet bowl, and is in a "down" condition when that toilet seat is resting on the toilet bowl and is located in a plane that is nearly parallel to the plane containing the top rim of the toilet seat.

People in the second group often simply forget to replace the toilet seat in a "down" condition covering the toilet bowl after using the toilet.

Therefore, there is a need for a toilet seat lifting mechanism that makes it easy to move a toilet seat into an "up" condition and to thereafter return the toilet seat to the "down" condition.

The art contains numerous disclosures of toilet seat lifting mechanisms. However, these mechanisms all have various drawbacks, from requiring a person to grasp a handle to being complicated and hence difficult to install and prone to malfunctions. If a person must grasp a handle connected to the toilet seat, this will discourage people from operating the mechanism because they do not want to touch the toilet seat and it is the same thing as simply moving the seat back by hand and thus is of questionable value for this purpose. If the mechanism is difficult to install, it may be expensive to install and may not be usable for a retrofit application. This is an especially important drawback for mechanisms that require a great deal of structural elements or which require electronic equipment.

The art also contains toilet seat lifting mechanisms that are operated by stepping on a foot pedal. However, these mechanisms are prone to failure since they use cables and the like. Cables are required because the mechanism connecting the foot pedal to the toilet seat includes a first class lever and movement of a toilet seat from a "down" condition to an "up" condition with a mechanism that, uses a cable that requires the use of a first class lever. Cables can become frayed and may break or be difficult to keep clean. As used herein, a first class lever is a lever in which the fulcrum is located between the force and the weight being moved, a second class lever is a lever in which the weight is located between the fulcrum and the force, and a third class lever is a lever in which the force is located between the fulcrum and the weight being moved.

Therefore, there is a need for a toilet seat lifting mechanism that is easy to operate, install, maintain and which is reliable.

Still further, many of the toilet seat lifting mechanisms of the prior art locate a foot pedal to the side of the toilet bowl. This makes it difficult for a person to reach the foot pedal, and may even discourage the person from making the effort.

Therefore, there is a need for a toilet seat lifting mechanism that has an operating pedal located so a person is encouraged to use the mechanism.

PRINCIPAL OBJECTS OF THE INVENTION

It is a main object of the present invention to provide a toilet seat lifting mechanism which makes it easy to move a toilet seat into an "up" condition and to thereafter return the toilet seat to the "down" condition.

It is another object of the present invention to provide a toilet seat lifting mechanism that is easy to operate, install, maintain and which is reliable.

It is another object of the present invention to provide a toilet seat lifting mechanism that has an operating pedal located so a person is encouraged to use the mechanism.

SUMMARY OF THE INVENTION

These, and other, objects are achieved by a toilet seat unit which includes a third class lever and has a foot pedal located in front of the toilet bowl. The structural elements and the operation and function of the unit embodying the present invention makes the seat easily and conveniently moved without the use of cables or the like.

Broadly, the toilet seat unit embodying the present invention comprises a toilet seat having a forward section and an aft section; a hinge pivotably attaching the aft section of the toilet seat to a bowl, the toilet seat moving between a "closed" condition with the forward section of the toilet seat resting on the bowl and an "open" condition with the aft section of the toilet seat spaced apart from the toilet bowl as the toilet seat extends upwardly from the bowl; a toilet seat lifting mechanism which includes a base, a fulcrum pivotably connected to the base and resting on the floor adjacent to the bowl, a foot pedal attached to a proximal section of the base of the toilet seat lifting mechanism, a connecting unit pivotably connected to a distal section of the base of the toilet seat lifting mechanism, a seat mount fixed to the toilet seat, a pivot mechanism pivotably connecting the seat mount to the connecting unit of the toilet seat lifting mechanism, the pivot mechanism being located between the hinge and the forward section of the toilet seat; the base of the toilet seat lifting mechanism pivoting about the fulcrum of the toilet seat lifting mechanism in a manner of a first class lever to move between a first position with the foot pedal of the toilet seat lifting mechanism spaced upwardly from a floor on which the toilet bowl is supported and a second position with the foot pedal resting on the floor on which the toilet bowl is supported; and the seat mount pivoting about the hinge in the manner of a third class lever to move between the "open" condition and the "closed" condition, with the third class lever including the connection between the toilet seat and the hinge, the pivot mechanism pivotally connecting the seat mount to the connecting unit of the toilet seat lifting mechanism and the seat mount fixed to the toilet seat.

BRIEF DESCRIPTION OF THE DRAWING FIGURES

DETAILED DESCRIPTION OF THE PREFERRED EMBODIMENT

Figure 2:
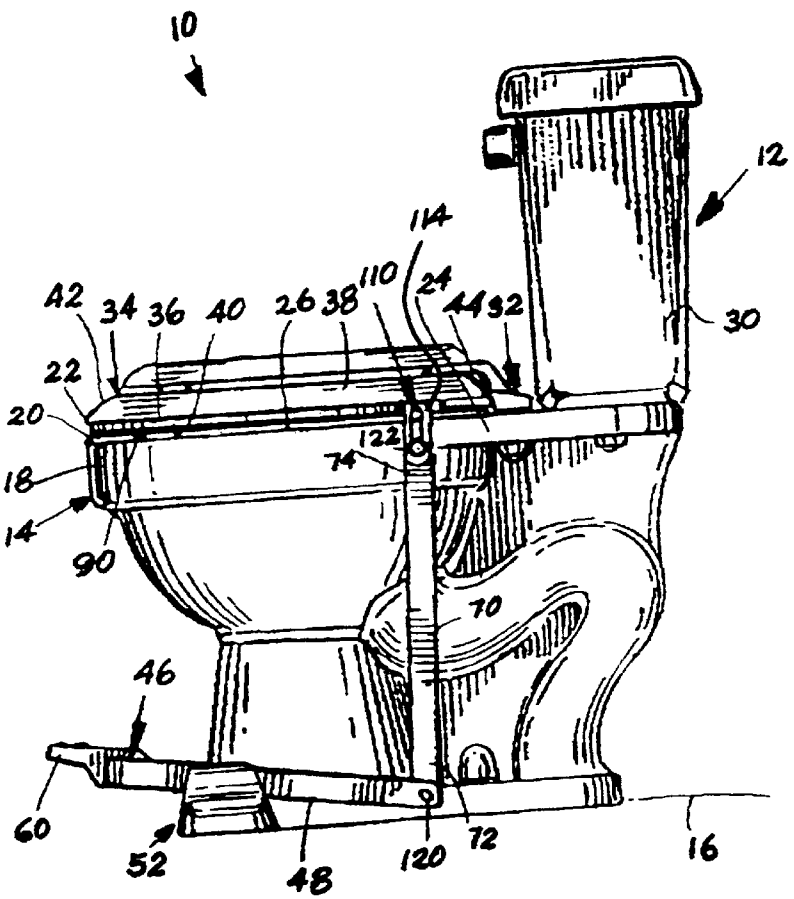
FIG. 2 is a perspective view of a toilet seat unit which includes the toilet seat lifting mechanism embodying the present invention in combination with a toilet.

Other objects, features and advantages of the invention will become apparent from a consideration of the following detailed description and the accompanying drawings.

As shown in the figures, the present invention is embodied in a toilet seat unit 10 which comprises a toilet 12 which has a bowl 14 mounted on a floor 16 and which has a frame 18 with a top rim 20, a forward section 22, an aft section 24, a first side section 26 connecting the forward section 22 of the bowl 14 to the aft section 24 of the bowl 14 and a second side section (not shown in FIG. 2, but identical in reverse to side section 26 shown) connecting the forward section 22 of the bowl 14 to the aft section 24 of the bowl 14. A water tank 30 is fluidically connected to the bowl 14 in the manner known to those skilled in the art. A hinge 32 is mounted on the frame 18 of the bowl 14 near the aft section 24 of the bowl 14.

A toilet seat 34 has an outer perimeter 36, a first surface 38, a second surface 40, a forward end 42, and an aft end 44 which is located near the aft section 24 of the bowl 14. The aft end 44 of the toilet seat 34 is pivotably connected to the hinge 32. The toilet seat 34 is movable between a "closed" condition (shown in FIG. 2) in which the second surface 40 of the toilet seat 34 is in contact with the top rim 20 of the bowl 14 and an "open" condition (not shown, but those skilled in the art will be able to understand this condition based on the teaching of this disclosure and their own knowledge) in which the second surface 40 of the toilet seat 34 is spaced apart from the top rim 20 of the bowl 14.

Figure 1:
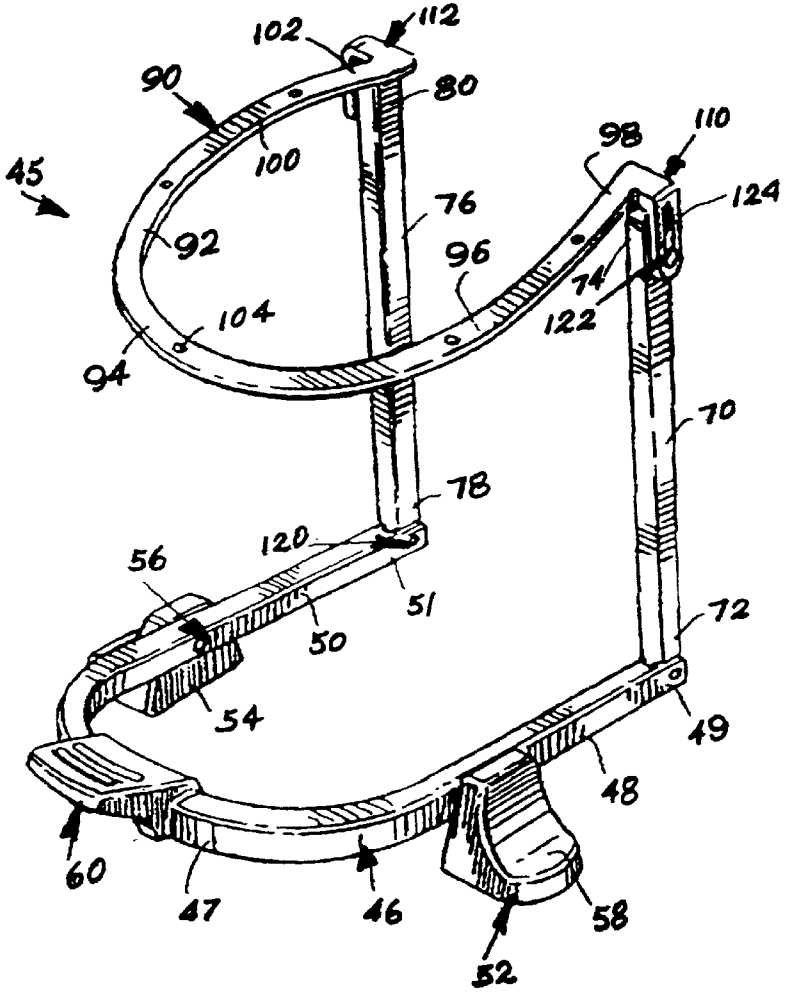
FIG. 1 is a perspective view of a toilet seat lifting mechanism embodying the present invention.

A toilet seat lifting mechanism 45 is shown in FIGS. 1 and 2 and moves the toilet seat 34 between the "open" condition and the "closed" condition. The toilet seat lifting mechanism 45 includes a U-shaped base 46 located adjacent to the bowl 14 and rests on the floor 16 adjacent to the bowl 14. Base 46 includes a bight section 47 located adjacent to the forward section 22 of the bowl 14, a first leg 48 extending adjacent to the first side section 26 of the bowl 14 and having a distal end 46 located near the aft section 24 of the bowl 14. A second leg 50 extends adjacent to the second side section of the bowl 14 and has a distal end 50 located near the aft section 24 of the bowl 14. A first fulcrum-defining element 52 is pivotably attached to the first leg 48 between the bight section 47 of the base 46 and the distal end 49 of the first leg 48 of the base 46 and a second fulcrum-defining element 54 is pivotably attached to the second leg 50 between the bight section 47 of the base 46 and the distal end 51 of the second leg 50 of the base 46. Pivot pins, such as pivot pin 56, pivotably attach foot-like elements, such as element 58, to base 46.

A foot pedal 60 is mounted on the bight section 47 of the base 46 adjacent to the forward section 22 of the bowl 14 and extends forward from the forward section 22 of the bowl 14 to be in a position for easy and ready access by a person who desires to lift the toilet seat 34 from the "closed" condition to the "open" condition. As will be understood from the teaching of the present disclosure, the toilet seat 34 is moved by simply pressing down on the foot pedal 60.

The U-shaped base 46 forms a first class lever with the fulcrum-defining elements 52, 54 located between the foot pedal 60 mounted on the bight section 47 of the base 46 and the distal ends 49, 51 of the first and second legs 48, 50. The U-shaped base 46 moves between a first orientation (not shown, but one skilled in the art will be able to envision this orientation based on the teaching of this disclosure) with the bight section 47 of the base 46 in contact with the floor 16 adjacent to the forward section 22 of the bowl 14 and the distal ends 49, 51 of the legs 48, 50 of the base 46 spaced above the floor 16 adjacent to the aft section 24 of the bowl 14 and a second orientation (shown in FIG. 2) with the bight section 47 of the base 46 spaced above the floor 16 adjacent to the forward section 22 of the bowl 14 and the distal ends 49, 51 of the legs 48, 50 of the base 46 located closely adjacent to the floor 16 adjacent to the aft section 24 of the bowl 14. The toilet seat 34 will be in a "closed" condition when the base 46 is in the second orientation, and will be in an "open" condition when the base 46 is in the first orientation.

A first connecting link 70 has a proximal end 72 connected to the distal end 49 of the first leg 48 of the base 46 for movement therewith and a distal end 74 located adjacent to the first side section 26 of the toilet bowl 14 near the top rim 20 of the bowl 14. A second connecting link 76 has a proximal end 78 connected to the distal end 51 of the second leg 50 of the base 46 for movement therewith and a distal end 80 located adjacent to the second side section of the toilet bowl 14 near the top rim 20 of the bowl 14.

The first connecting link 70 and the second connecting link 76 move between a first position (not shown) having the distal ends 74, 80 of the first and second connecting links 70, 76 spaced above a plane containing the top rim 20 of the bowl 14 when the base 46 is in the first orientation and a second position (shown in FIG. 2) having the distal ends 74, 80 of the first and second connecting links 70, 76 spaced near the plane containing the top rim 20 of the bowl 14 when the base 46 is in the second orientation.

A toilet seat mount 90 is fastened to the second surface 40 of the toilet seat 14 and includes a U-shaped body 92, a bight section 94 on the U-shaped body 92 of the toilet seat mount 90 and located near the forward end 42 of the toilet seat 34, a first leg 96 on the U-shaped body 92 of the toilet seat mount 90 and which is located near the first side section 26 of the toilet seat 34 and which extends from the bight section 94 of the toilet seat mount 90 to the aft end 44 of the toilet seat 34, a distal end 98 on the first leg 96 of the U-shaped body 92 of the toilet seat mount 90 and located near the aft end 44 of the toilet seat 34, a second leg 100 on the U-shaped body 92 of the toilet seat mount 90 and which is located near the second side section of the toilet seat and which extends from the bight section 94 of the toilet seat mount 90 to the aft end 44 of the toilet seat 34, and a distal end 102 on the second leg 100 of the U-shaped body 92 of the toilet seat mount 90 and located near the aft end 44 of the toilet seat 34. Fasteners, such as screws or the like extend through bores, such as bore 104, and are used to attach the toilet seat mount 90 to the toilet seat 34.

A first pivot fastener 110 pivotably connects the distal end 98 of the first leg 96 of the U-shaped body 92 of the toilet seat mount 90 to the distal end 74 of the first connecting link 70 of the toilet seat lifting mechanism, and a second pivot fastener 112 pivotably connects the distal end 102 of the second leg 100 of the U-shaped body 92 of the toilet seat mount 90 to the distal end 80 of the second connecting link 76 of the toilet seat lifting mechanism.

The first pivot fastener 110 is located between the aft end 44 of the toilet seat 34 and the forward end 42 of the toilet seat 34 to be located between the hinge 32 of the toilet 12 and the forward end 42 of the toilet seat 34. The second pivot fastener 112 is located between the aft end 44 of the toilet seat 34 and the forward end 42 of the toilet seat 34 to be located between the hinge 32 of the toilet 12 and the forward end 42 of the toilet seat 34.

Pivot pins, such as pivot pins 120 and 122, effect the pivotable connections discussed above. A lost motion-type connection, such as connection 124, can also be used to effect the pivotable connection between ling 70 and distal end 98, and between link 76 and distal end 102.

A first third class lever 114 is formed by the first leg 96 of the U-shaped body 92 of the toilet seat mount 90 and the first pivot fastener 110 and the hinge 32 of the toilet 12 with the hinge 32 of the toilet 12 being the fulcrum of the first third class lever. A second third class lever is identical to the just-described first third class lever and is formed by the second leg 100 of the U-shaped body 92 of the toilet seat mount 90 and the second pivot fastener 112 and the hinge 32 of the toilet 12 with the hinge 32 of the toilet 12 being the fulcrum of the second class lever.

The toilet seat 34 is in the "closed" condition when the U-shaped base 92 is in the second orientation (shown in FIG. 2) and the toilet seat 34 is in the "open" condition when the U-shaped base 92 is in the first orientation.

It is understood that while certain forms of the present invention have been illustrated and described herein, it is not to be limited to the specific forms or arrangements of parts described and shown.

What is claimed and desired to be protected by Letters Patent is:

1. A toilet seat unit comprising:

a) a toilet having (1) a bowl mounted on a floor and having a frame with a top rim, a forward section, an aft section, a first side section connecting the forward section of the bowl to the aft section of the bowl and a second side section connecting the forward section of the bowl to the aft section of the bowl, (2) a water tank fluidically connected to the bowl, (3) a hinge mounted on the frame of the bowl near the aft section of the bowl, (4) a toilet seat having (A) an outer perimeter, (B) a first surface, (C) a second surface, (D) a forward section, and (E) an aft section which is located near the aft section of the bowl, (5) the aft section of the toilet seat being pivotably connected to the hinge, (6) the toilet seat being movable between a "closed" condition in which the second surface of the toilet seat is in contact with the top rim of the bowl and an "open" condition in which the second surface of the toilet seat is spaced apart from the top rim of the bowl; and b) a toilet seat lifting mechanism which moves the toilet seat between the "open" condition and the "closed" condition and which includes (1) a U-shaped base located adjacent to the bowl and which rests on the floor adjacent to the bowl, the base including (A) a bight section located adjacent to the forward section of the bowl, (B) a first leg extending adjacent to the first side section of the bowl and having a distal end located near the aft section of the bowl, and (C) a second leg extending adjacent to the second side section of the bowl and having a distal end located near the aft section of the bowl, (2) a first fulcrum-defining element pivotably attached to the first leg between the bight section of the base and the distal end of the first leg of the base, (3) a second fulcrum-defining element pivotably attached to the second leg between the bight section of the base and the distal end of the second leg of the base, (4) a foot pedal mounted on the bight section of the base adjacent to the forward section of the bowl and extending forward from the forward section of the bowl, (5) the U-shaped base forming a first class lever with the fulcrum-defining elements located between the foot pedal mounted on the bight section of the base and the distal ends of the first and second legs, the U-shaped base moving between a first orientation with the bight section of the base in contact with the floor adjacent to the forward section of the bowl and the distal ends of the legs of the base spaced above the floor adjacent to the aft section of the bowl and a second orientation with the bight section of the base spaced above the floor adjacent to the forward section of the bowl and the distal ends of the legs of the base closely adjacent to the floor adjacent to the aft section of the bowl, (6) a first connecting link having a proximal end connected to the distal end of the first leg of the base for movement therewith and a distal end located adjacent to the first side section of the toilet bowl near the top rim of the bowl, (7) a second connecting link having a proximal end connected to the distal end of the second leg of the base for movement therewith and a distal end located adjacent to the second side section of the toilet bowl near the top rim of the bowl, (8) the first connecting link and the second connecting link moving between a first position having the distal ends of the first and second connecting links spaced above a plane containing the top rim of the bowl when the base is in the first orientation and a second position having the distal ends of the first and second connecting links spaced near the plane containing the top rim of the bowl when the base is in the second orientation, (9) a toilet seat mount fastened to the second surface of the toilet seat and including (A) a U-shaped body, (B) a bight section on the U-shaped body of the toilet seat mount and located near the forward section of the toilet seat, (C) a first leg on the U-shaped body of the toilet seat mount and which is located near the first side section of the toilet seat and which extends from the bight section of the toilet seat mount to the aft section of the toilet seat, (D) a distal end on the first leg of the U-shaped body of the toilet seat mount and located near the aft section of the toilet seat, (E) a second leg on the U-shaped body of the toilet seat mount and which is located near the second side section of the toilet seat and which extends from the bight section of the toilet seat mount to the aft section of the toilet seat, and (F) a distal end on the second leg of the U-shaped body of the toilet seat mount and located near the aft section of the toilet seat,

(10) a first pivot fastener pivotably connecting the distal end of the first leg on the U-shaped body of the toilet seat mount to the distal end of the first connecting link of said toilet seat lifting mechanism,

(11) a second pivot fastener pivotably connecting the distal end of the second leg on the U-shaped body of the toilet seat mount to the distal end of the second connecting link of said toilet seat lifting mechanism,

(12) the first pivot fastener being located between the aft section of the toilet seat and the forward section of the toilet seat to be located between the hinge of said toilet and the forward section of the toilet seat,

(13) the second pivot fastener being located between the aft section of the toilet seat and the forward section of the toilet seat to be located between the hinge of said toilet and the forward section of the toilet seat,

(14) a first third class lever being formed by the first leg of the U-shaped body of the toilet seat mount and the first pivot fastener and the hinge of said toilet with the hinge of said toilet being the fulcrum of the first third class lever,

(15) a second third class lever being formed by the second leg of the U-shaped body of the toilet seat mount and the second pivot fastener and the hinge of said toilet with the hinge of said toilet being the fulcrum of the second third class lever, and

(16) the toilet seat being in the "closed" condition when the U-shaped base is in the second orientation and the toilet seat being in the "open" condition when the U-shaped base is in the first orientation.

* * * * *